United States Patent [19]

Roche

[11] Patent Number: 4,828,024

[45] **Date of Patent: * May 9, 1989**

[54] DIVERTER SYSTEM AND BLOWOUT PREVENTER

[75] Inventor: Joseph R. Roche, Humble, Tex.

[73] Assignee: Hydril Company, Los Angeles, Calif.

[ * ] Notice: The portion of the term of this patent subsequent to Oct. 15, 2002 has been disclaimed.

[21] Appl. No.: 268,792

[22] Filed: Nov. 9, 1988

Related U.S. Application Data

[63] Continuation of Ser. No. 888,287, Jul. 24, 1986, which is a continuation-in-part of Ser. No. 882,022, Jul. 31, 1986, abandoned, which is a continuation-in-part of Ser. No. 609,501, May 11, 1984, abandoned, which is a continuation-in-part of Ser. No. 569,790, Jan. 10, 1984, Pat. No. 4,546,828.

[51] Int. Cl.[4] ..... E21B 33/06

[52] U.S. Cl. ..... 166/84; 166/374; 137/869; 251/1.1

[58] Field of Search ..... 175/214, 218, 209, 7, 175/9; 166/82, 84, 95, 97, 75.1, 367, 53, 363, 368, 374, 364, 358, 87, 319, 88, 332, 321; 251/1.1, 1.2, 1.3, 63.5, 63.6, 343; 137/862, 865, 869, 872, 883, 885, 114, 861, 81.2, 236.1

[56] References Cited

U.S. PATENT DOCUMENTS

| | | | |
|---|---|---|---|
| 3,589,667 | 6/1971 | Lewis | 166/97 |
| 4,378,849 | 4/1983 | Wilks | 251/1.1 |
| 4,444,250 | 4/1984 | Keithahn et al. | 251/1.1 |
| 4,444,401 | 4/1984 | Roche et al. | 166/363 |
| 4,456,062 | 6/1984 | Roche et al. | 137/869 |
| 4,456,063 | 6/1984 | Roche | 166/84 |

*Primary Examiner*—Bruce M. Kisliuk

*Attorney, Agent, or Firm*—Dodge, Bush & Moseley

[57] ABSTRACT

A system is disclosed which may alternatively be used as a diverter or as a blowout preventer for a drilling rig. The system comprises a blowout preventer attached above a spool having a hydraulically driven sleeve/piston. An outlet flow passage in the spool, which may be connected to a vent line, is closed off by the sleeve wall when the spool piston is at rest.

Hydraulic ports are connected above and below the blowout preventer annular piston and above and below the spool annular piston. The ports below the blowout preventer piston and above the spool piston are in fluid communication with each other. A hydraulic circuit is provided having two valves between a source of pressurized hydraulic fluid and a drain.

12 Claims, 7 Drawing Sheets

FIG. 12
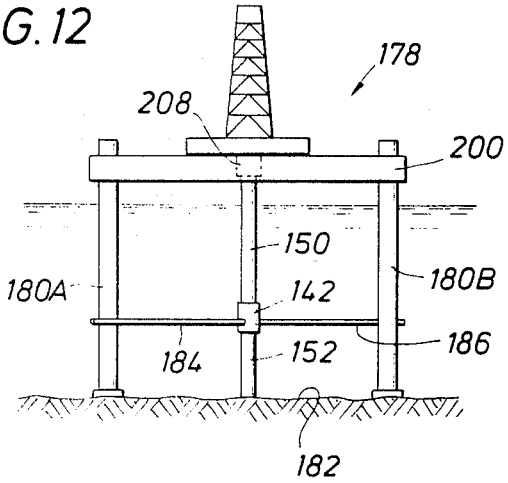
FIG. 13
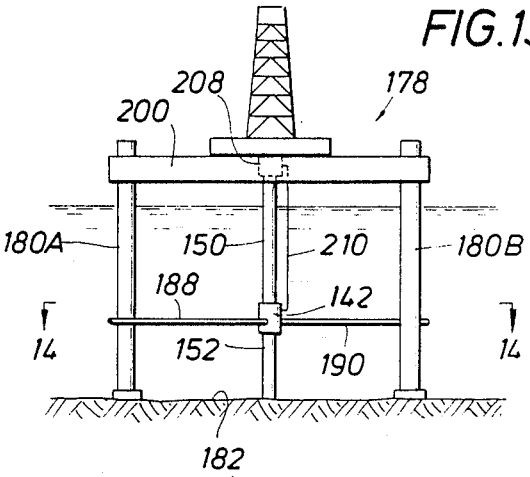
FIG. 14
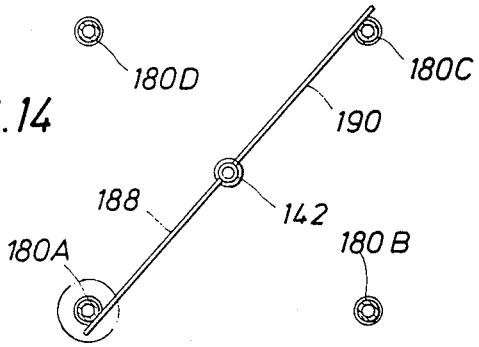
FIG. 15
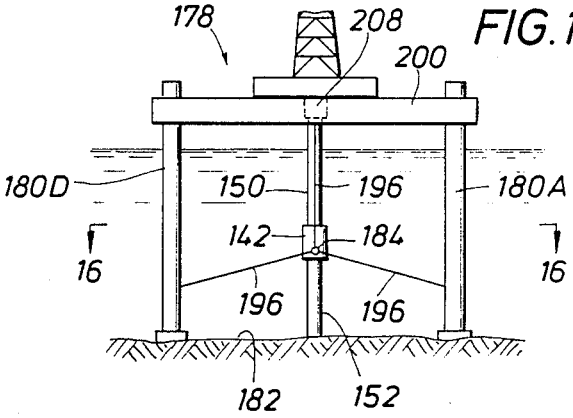
FIG. 14A
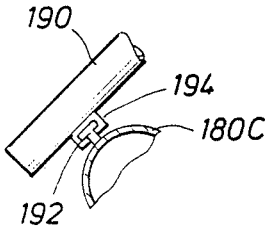
FIG. 16
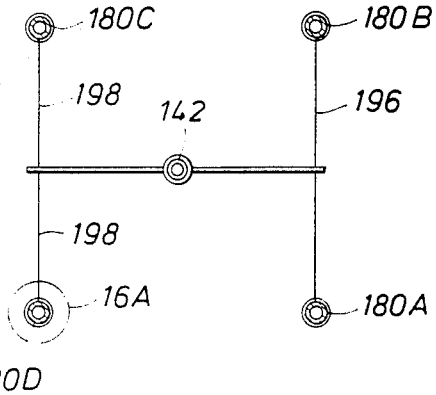
FIG. 16A
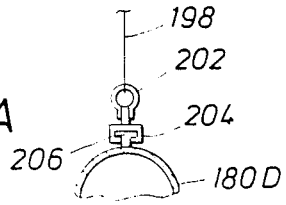
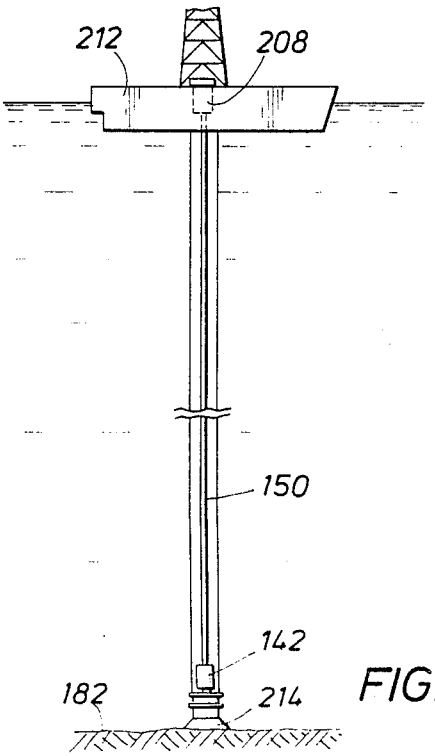
FIG. 17

DIVERTER SYSTEM AND BLOWOUT PREVENTER

BACKGROUND OF THE INVENTION

Cross Reference to Related Applications

This application is a continuation of application Ser. No. 888,287, filed July 24, 1986 which is a continuation-in-part of Ser. No. 882,022 filed July 3, 1986, now abandoned, which is a continuation-in-part of 609,501 filed May 11, 1984, now abandoned, which is a continuation-in-part of Ser. No. 569,790 filed Jan. 10, 1984 now U.S. Pat. No. 4,546,828.

FIELD OF THE INVENTION

This invention relates in general to diverters and blowout preventer systems for drilling rigs. In particular, the invention relates to a system adapted for alternative use as a diverter or a blowout preventer.

DESCRIPTION OF THE PRIOR ART

Diverter systems are known for drilling rigs in which a diverter element is provided in the support housing attached to the support beams beneath the drilling rig rotary table. Such diverter systems have provided a vent line and a flow line in the permanent housing beneath the rotary table. Such systems have required external valve systems in the vent line to open the fluid system to the vent line when the diverter is closed so that fluid flow may be directed away from the drilling rig. Such diverter systems have been provided not only for floating vessel drilling rigs, but also for bottom supported offshore drilling rigs and for land rigs.

Fatal and costly accidents have resulted from the complexity of the prior art diverter systems described above. Typical prior art diverter systems have included an annulus closing device, external vent and flow line valves, actuators, limit switches and sequence controls. This complicated valving and piping of the prior art has been further complicated by the inherent risks of manipulating loose packer inserts into the diverter itself. The complexity of the prior art systems has invited a variety of human error and equipment malfunctions.

One problem with the prior art systems has involved the use of external valving in the diverter system. Valves which are external to the diverter unit not only add clutter to the diverter system and the rig configuration, they have also required multiple control functions which are required to operate correctly. For example, prior art diverter system valves have required an actuating pressure signal that is regulated to a discrete pressure level different from the operating pressure level of the diverter unit. The need for separate and different control functions executed in only one safe sequence has required separate pressure regulators and connecting functional components that are in different locations on the underside of the rig floor. Such a requirement has invited mistakes and malfunctions.

In addition to the problem of multiple control functions, there has existed problems with mistakenly crossed hydraulic connections in prior art diverter systems. Misconnection of control lines can cause a valve to be closed when it should be open or vice versa potentially resulting in an explosion in the diverter system or breach of the casing.

Another problem of the prior art diverter systems has been exposure to the working environment of delicate parts such as hydraulic tubing and fittings, limit switches, mechanical linkages and valve actuators. Such exposure has in the past caused occasional breakage and damage to such parts. Delicate parts can be damaged or broken by impact with heavy equipment, use as steps or handholds by working personnel, or vibrations induced by running equipment. System malfunctions which result from such damage can be catastrophic.

Another hazard of prior art diverter systems has been the result of vent line blockage because the vent valve has been remote from the diverter unit itself. A stagnant space has existed at a critical location in the vent line. Build up of ice or other solids and/or caking of mud in such a dead space may cause the critically important vent line to be choked off. A restricted or shut-off vent line may cause a dangerous pressure increase while being called upon to divert.

Still another problem of priort art diverter systems has involved the use of component sources from a number of different manufacturers. The annulus closing device, vent and flow line valves, actuators, sequencing devices and control system components have typically each been provided by a different manufacturer. Rig operating personnel are usually burdened with devising the vent line valve circuit interconnecting the components (which are often widely physically separated when installed) and stocking a varied assortment of spare parts using extraordinary caution to avoid misconnections and keeping a number of rig personnel trained to operate and maintain a diverse assortment of complicated components.

Some prior art diverter systems for bottom supported rigs have included the use of a high pressure external valve in the vent line to control the diverting function. Closure of such a valve has enabled the diverter to be converted to a blowout preventer after sufficient casing pressure integrity has been established during drilling operations. However, if this valve should inadvertently be closed during an attempt to divert, breach of the casing or explosion of the diverter system could threaten the safety of the rig itself.

Still another problem of prior art diverter systems has been the result of valve mismatch. While many different types of valves have been used in diverter systems, there has been no single valve that is especially well suited to the particular application of a diverter system. Selection of the type, size and rating of such valves has been a vexing puzzle for designers of rig valve systems which has been required to be solved usually when a new drilling rig is being built.

Perhaps the most destructive problem of the prior art diverter systems has been the inherent risk of pressure testing in situ. Pressure testing of prior diverter systems has been accomplished by overriding the safety sequencing in the valves so that the vent line valve is closed simultaneously with closure of the annulus. Such problem is inherent not only in the packer insert type diverter systems, but also the annular blowout preventer/spool type diverter systems. Disastrous results have been experienced when the safety overriding mechanism has been unintentionally left in place when testing is completed and drilling is resumed.

Still another problem in the prior art is the effects of the initial flow of fluid and solids in the event of a shallow gas kick. Forces from this initial flow create high pressures on the drilling rig including the blowout preventer seals and huge reaction forces on supports for the vent lines.

IDENTIFICATION OF THE OBJECTS OF THE INVENTION

It is therefore a primary object of this invention to overcome the disadvantages and problems and inherent safety risks of the prior art diverter systems.

It is another object of the invention to provide a system which may be remotely controlled for alternative use as a diverter system or as a blowout preventer system.

It is another object of the invention to provide a system designed for alternative use as a diverter system or annular blowout preventer system in which in the diverter mode, the opening of a vent line occurs sequentially before the closing of the annulus by the system.

It is still another object of the invention to provide a hydraulic control system for the operation of the system adapted for alternative use as a diverter or a blowout preventer system. In other words, it is an object to provide via remote hydraulic controls a hydraulic signal to the unit for performing an inherently safe execution of the rerouting of flow of a well kick or, after deliberate reconfiguration of the system, for closing in the well in a blowout preventer mode.

It is another object of the invention to provide a system having no stagnant space, a system in which the vent flow is immediately opened when the system is operating in a diverter mode and begins to divert flow away from the work area. Avoiding the stagnant space eliminates a place for caking of solids that may obstruct or shut-off vent flow.

Another object according to the alternative embodiment of the invention is to provide a combined diverter system/blowout preventer system wherein the hydraulic circuit means comprises a single hydraulic valve having an open position and a close position thereby providing in a first mode inherently safe execuiton of rerouting of the flow of pressurized well fluid and in a second mode a blowout preventer.

It is another object according to the alternative embodiment of the invention to provide a diverter system using a single hydraulic valve where a vent line may be connected to an outlet passage in the diverter spool housing so that when the blowout preventer closes and the diverter piston raises, the vertical path is closed by the blowout preventer and a vent line to divert fluid flow through the outlet passage is opened.

It is another object according to the alternative embodiment of the invention to provide a blowout preventer system using a single hydraulic valve having an open position and a close position so that upon actuation of the valve, the blowout preventer closes and the diverter piston raises in the diverter spool housing to open an outlet passage which is sealed by a blind flange or hub thereby presenting a blowout preventer pressure containment system.

It is another object according to an alternative embodiment of the invention to provide a subsea diverter spool hydraulically connected to a blowout preventer disposed above sea level, wherein the subsea diverter spool is provided with vent lines extending from its outlet passage, and wherein the vent lines are economically and effectively connected to longitudinal structural members of the bottom supported drilling rig.

SUMMARY OF THE INVENTION

According to the invention, a system is provided achieving the above identified objects as well as other advantages and features for use with drilling rigs, offshore and land drilling rigs, which is adapted for alternative use as a diverter or a blowout preventer, especially during the initial drilling phases of a borehole. The system comprises a blowout preventer having a resilient packing means and having a closing port and an opening port by which connection of a source of pressurized hydraulic fluid to the closing port closes the blockout preventer and connection of a source of pressurized hydraulic control fluid to the opening port opens the blowout preventer. A spool means is provided in series with and below the blowout preventer. The spool means has a housing with vent outlet passages provided in its wall.

A diverter piston having an annular wall is disposed within the housing. A lower port in the housing is provided by which connection of a source of pressurized hydraulic control fluid to the lower port raises the piston from a lower position to an upper position and an upper port by which connection of a source of pressurized hydraulic control fluid to the upper port lowers said piston from an upper position to a lower position in the housing.

The vent outlet passage in the housing wall is covered by the annular wall of the piston means when it is in the lower position. The vent outlet passage is open to the interior of the housing when the piston is above the lower position. Hydraulic circuit means are provided for connecting a source of pressurized hydraulic control fluid to the closing port of the blowout preventer thereby closing the blowout preventer while insuring that the outlet passage in the diverter housing remains covered by the diverter piston wall. The hydraulic circuit means is also provided for alternatively connecting a source of pressurized hydraulic control fluid to the lower port in the diverter housing thereby raising the diverter piston from its lower position and uncovering the vent outlet in the spool wall and sequentially closing the blowout preventer.

In a first embodiment of the invention, the blowout preventer of the novel system is an annular blowout preventer adapted for closing the annulus between a drill pipe or other object and the interior vertical bore of the preventer or completely closing and sealing the vertical bore of the preventer in the absence of any object in the preventer. Other annulus sealing apparatus may be used as a substitute for an annular blowout preventer, for example an inflatable doughnut shaped packer may be used for certain applications of the novel system described below.

A vent line is preferably connected to the vent outlet passage provided in the housing wall of the spool to conduct pressurized well fluid away from the drilling rig on the occurrence of a kick.

According to the first embodiment of the invention, the hydraulic circuit means comprises a first hydraulic two position valve having an open position and a close position and a second hydraulic two position valve having a BOP position and a divert position. Hydraulic lines are connected respectively between the opening port of the BOP and the first hydraulic valve, between the first and second hydraulic valves, between the second hydraulic valve and the lower port of the housing of the diverter means, and among the upper port of the housing of the spool means and the closing port of the blowout preventer and the second hydraulic valve.

A closed and sealed reservoir of hydrualic fluid is disposed in the diverter housing above the diverter piston when the piston is in the lower position. When the first hydraulic valve is in the open position, a source of pressurized hydraulic control fluid is applied to the open port of the BOP thereby opening the BOP and maintaining the diverter position in its lower position.

When the first hydraulic valve is in the closed position and the second hydraulic valve is in the divert position, the source of hydraulic fluid is applied to the lower port of the spool neans thereby raising the diverter piston from a lower position to an upper position, uncovering the outlet passage in the housing, forcing the reservoir of hydraulic fluid above the diverter piston to the closing port of the BOP via the hydraulic line between the upper port of the housing of the spool means and the closing port of the BOP thereby sequentially closing the BOP after the outlet passage in the diverter housing is opened.

When the first hydraulic valve is in the closed position and the second hydraulic valve is in the BOP position, the source of hydraulic fluid is applied to the closing port of the BOP and the upper port of the spool means thereby closing the BOP and maintaining the diverter piston in its lower position.

According to a second embodiment of the invention, a system is provided for use with drilling rigs, both for offshore and land drilling rigs, which is adapted for alternative use as a blowout preventer or a diverter, especially during the initial drilling phases of a borehole. The system comprises a blowout preventer having resilient packing means and having a closing port and an opening port by which providing pressurized hydraulic control fluid to the closing port closes the blowout preventer and providing pressurized hydraulic control fluid to the opening port opens the blowout preventer. Although an annular BOP is preferred for this second embodiment of the invention, other types of BOP's which are adapted to seal about an object in its vertical flow path may be used for certain applications.

A diverter spool means is provided in series with and below the blowout preventer. The spool means has an outlet passage provided in its wall. A diverter piston having an annular wall is disposed within the housing. A lower control port in the housing is provided by which providing pressurized hydraulic fluid to the lower port raises the piston from a lower position to an upper position and an upper control port by which providing pressurized hydraulic fluid to the upper port lowers the piston from an upper position to a lower position in the housing. The outlet passage in the housing wall is closed off by the annular wall of the piston when the piston is in the lower position. The outlet passage is open to the interior of the housing when the piston is lifted off.

Hydraulic circuit means for the second embodiment of the invention provide pressurized hydraulic fluid to the closing port of the blowout preventer thereby closing the blowout preventer and provide pressurized hydraulic fluid to the lower port in the diverter housing thereby raising the diverter piston from its lower position and opening the outlet passage.

According to the second embodimemt of the invention, the hydraulic circuit means comprises a hydraulic valve having an open position and a close position. Hydraulic lines are connected respectively between the opening port of the blowout preventer and the hydraulic valve, between the hydraulic valve and the lower port of the housing of the diverter spool means, and between the closing port of the housing of the diverter spool means and the closing port of the blowout preventer.

A sealed reservoir of hydraulic control fluid is disposed in the diverter housing above the diverter piston when the piston is in the lower position. When the hydraulic valve is in the open position, a source of pressurized hydraulic fluid is applied to the opening port of the blowout preventer thereby opening the blowout preventer and maintaining the diverter piston in its lower position.

When the hydraulic valve is in the close position, a source of pressurized hydraulic fluid is applied to the lower port of the diverter spool means operably raising the diverter piston from a lower position to an upper position, opening the outlet passage in the housing, displacing the reservoir of hydraulic fluid above the diverter piston to the closing chamber of the blowout preventer via the hydraulic line between the upper port of the housing of the spool means and the closing port of the blowout preventer and operably sequentially closing the blowout preventer after the outlet passage in the diverter housing has opened.

Preferably, in the second embodiment of the invention, the blowout preventer is an annular blowout preventer adapted for closing the annulus between a drill pipe or other object and the interior vertical well fluid flow path of the preventer or completely closing the vertical flow path in the absence of any object in the preventer. As stated above, other annulus sealing means, such as those having hydraulically actuated blowout preventer inserts may be used to seal the vertical flow path about a drill pipe or other object.

In the second embodiment of the invention, a vent line may be connected to the outlet passage provided in the housing wall of the diverter spool means thereby providing a divert mode for the system when said diverter piston raises from its lower position and opens the outlet passage while sequentially closing the blowout preventer. A blast deflector/selector may be connected to the vent line.

In the second embodiment of the invention, a blind flange or hub may be connected to the outlet passage provided in the housing wall of the diverter spool means thereby providing a blowout preventer pressure containment mode for the system when the diverter piston raises from its lower position closing the blowout preventer whereby the blind flange seals the outlet passage thereby preventing fluid communication therethrough. Such an embodiment obviates the need for a selector valve in the control system.

In an alternative embodiment of the invention a subsea diverter spool is provided with the blowout preventer positioned above sea level. The subsea diverter spool is provided with a vent line which is attached to a bottom supported rig structural member. The subsea diverter spool may advantageously include an automatic opening device for the vent line and an apparatus to effectively diffuse the fluids subsea resulting resulting from a kick.

BRIEF DESCRIPTION OF THE DRAWINGS

The objects, advantages and features of the invention will become more apparent by reference to the drawings which are appended hereto and wherein like numerals indicate like parts and wherein an illustrative embodiment of the invention is presented of which:

FIG. 12 is an elevational view of a bottom supported drilling rig illustrating the positioning of the subsea diverter spool relative to the blowout preventer, FIG. 13 is an elevational view illustrating the hydraulic connection between the subsea diverter spool and the blowout preventer and further illustrates securement of the vent line to the bottom supported drilling rig, FIG. 14 is a section view along lines 14—14 of FIG. 13 and FIG. 14A is a detail view of the connection of the vent line to a structural member of the drilling rig, FIG. 15 is a side view of FIG. 12, FIG. 16 is a section view taken along lines 16—16 of FIG. 13 and FIG. 16A is a detail view of the alternative securement of the vent line to a structural member of the drilling rig, and FIG. 17 is an elevational view of a floating drilling platform illustrating the location of the diverter.

DESCRIPTION OF THE INVENTION

Figure 1:
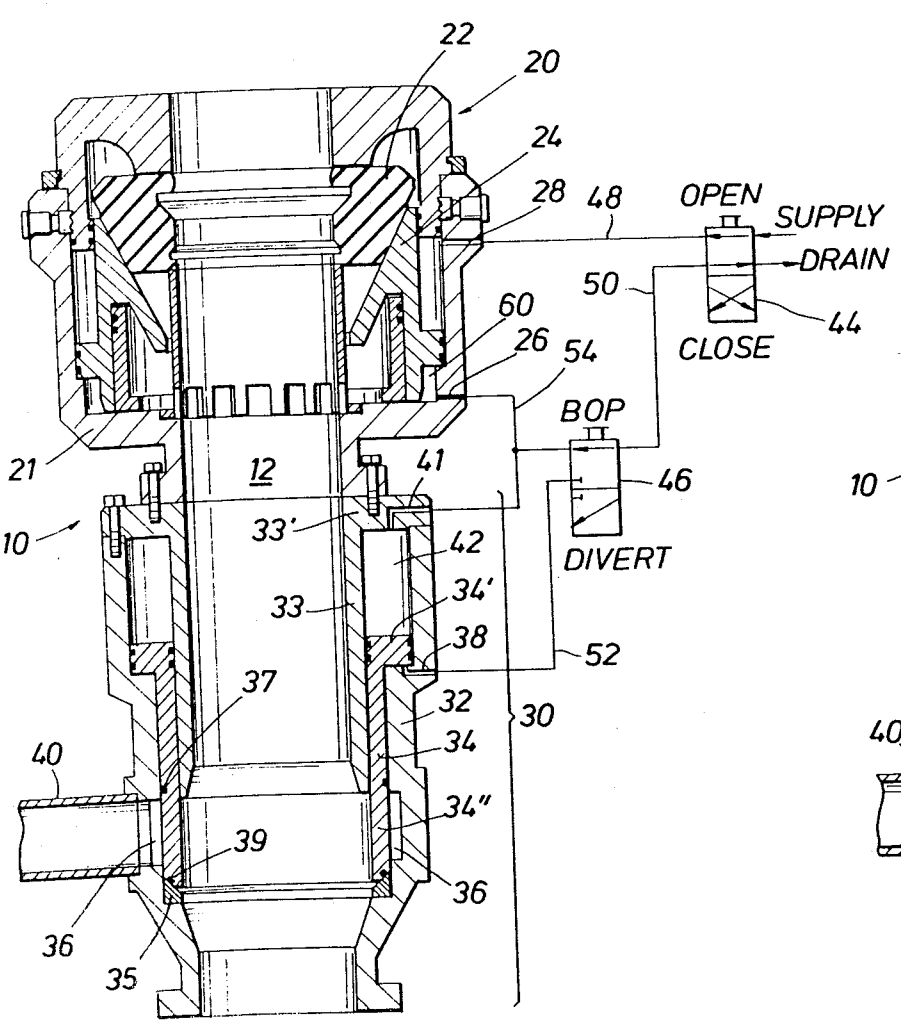
FIG. 1 illustrates the system, according to the invention, of an annular blowout preventer connected in series above a spool having a diverter annular piston and opening in the spool housing and a hydraulic circuit for alternatively connecting the system as a diverter or a BOP. The system of FIG. 1 shows the system having an opened vertical flow path.

FIG. 1 shows a system 10 adapted for alternative use as a diverter or a blowout preventer for use with a drilling rig. Although the system could find application in a floating drilling rig or even a land rig, its preferred application would be for bottom founded offshore drilling rigs. This spatial arrangement will be discussed below and is illustrated in FIGS. 12–17.

According to the invention, a blowout preventer 20 is connected in series above a diverter spool 30. Although illustrated schematically as two separate units, the diverter spool housing 32 could be integral with the BOP housing 21. The flow line (not illustrated) directs mud returns flow under ordinary drilling conditions is positioned above the blowout preventer so that closure of the blowout preventer shuts off mud return flow to the mud pit. Alternatively, the diverter spool 30 could be separated vertically from the housing 21 of the BOP 20 by providing an intermediate spool between the two housings. Such a configuration would be adapted to the spatial arrangement necessities of, for example, an offshore drilling platform or bottom founded offshore drilling rig. A detailed disclosure of this spatial arrangement will be presented below and is illustrated in FIGS. 9–17.

According to the invention, the BOP 20 is preferably an annular type BOP having an annular packing unit 22, an annular piston 24, an opening port 28 and a closing port 26. Such an annular blowout preventer (BOP) is well known in the art and functions to close and seal the packing unit about an object in the vertical flow path or bore 12 or to completely close and seal the bore 12 in the absence of an object. The BOP functions to close about the vertical flow path when a source of pressurized hydraulic control fluid is applied to the closing port 26 or alternatively to open when a source of pressurized hydraulic control fluid is applied to the opening port 28. As discussed below, other types of annular sealing devices may be substituted for the BOP illustrated in FIG. 1 especially where only a divert mode for the system is desired.

As illustrated in FIG. 1, the opening port is connected to a source of pressurized hydraulic control fluid and the annular piston 24 is forced downwardly causing the packer unit 22 to open in the usual fashion.

According to the invention, the diverter spool 30 has a spool housing 32 in which is disposed a spool annular piston 34. A cylindrical member 33 is also disposed in the spool housing 32 defining an annular space between the spool housing 32 and the cylindrical member 33 in which the spool annular piston 34 is disposed. As illustrated in FIG. 1, the spool annular piston 34 is in a lower position. In such lower position, a reservoir 42 is provided between the upper part 34′ and the uppermost portion 33′ of sleeve member 33. The reservoir 42 is preferably filled with hydraulic control fluid.

An outlet passage 36 is provided in the lower part of the spool housing 32, and when the spool annular piston 34 is in the lower position, as illustrated in FIG. 1, the lower part 34″ of the spool piston 34 covers and seals the outlet passage 36. A vent line 40 is connected to the spool housing 32 for communication with the outlet passage 36. In the lower position of the spool piston 34, the outlet passage 36 is closed from communication within the vertical flow path 12 of the system to the vent line 40. Seal 39 serves to seal fluid from the vertical flow path 12 to the outlet passage 36 and vent line 40 when the spool annular piston 34 is in the lower position. In the preferred embodiment of the invention, a "sacrificial" seal seat ring 35 is provided below the bottom with seal 39 in sealing the outlet passage 36 from the vertical flow path. The ring 35 may be easily replaced if it should erode during the divert mode of the system 10.

According to the invention, lower port 38 is provided for directing a source of pressurized hydraulic fluid beneath the upper part 34' of spool annular piston 34 for the purpose of raising spool annular piston 34 within the spool housing 32. An upper port 41 is provided for lowering the spool piston 34 within the spool housing 32 when a source of pressurized hydraulic fluid is applied to the upper port 41.

According to the invention, a hydraulic circuit is provided for alternatively connecting the system as a diverter or as a blowout preventer. The hydraulic circuit comprises a first hydraulic valve 44 and a second hydraulic valve 46. A hydraulic line 48 is provided between the opening port 28 of the BOP and the first hydraulic valve 44. The hydraulic line 52 is provided between the lower port 38 and the second hydraulic valve 46. Another hydraulic line 50 is provided between the first hydraulic valve 44 and the second hydraulic valve 46. A hydraulic line 54 is provided between the closing port 26 of BOP 20 and the upper port 41 of the diverter spool 30. (Where housing 21 of the BOP and housing 32 of the spool 30 are integral, line 54 may be provided within the combined integral housing). Hydraulic line 54' connects the second hydraulic valve 46 to the line 54 between the closing port 26 of BOP 20 and the upper port 41 of the diverter spool 30.

In the positions illustrated of the first hydraulic valve 44 and the second hydraulic valve 46, a hydraulic path exists from a supply of pressurized hydraulic fluid through the first hydraulic valve 44 to the opening port 28 of BOP 20. Providing a source of pressurized hydraulic control fluid via the opening port 28 causes the annular piston 24 to remain in the lower portion thereby maintaining the packing unit 22 in the relaxed or open state. The fact that the annular piston 24 is in the lower position causes any hydraulic fluid in space 60 beneath the annular piston 24 to be forced downwardly and simultaneously via the output to the drain of the hydraulic fluid via line 54 and line 54' through the second hydraulic valve 46 and hydraulic line 50. The spool piston 34 remains in its lower position. In the position of the first and second hydraulic valves 44 and 46, as illustrated in FIG. 1, the spool piston 34 remains in its lower position, operably closing off flow from the upward vertical flow path 12 to the vent line 40, and the annular BOP 20 remains in an open position.

Figure 2:
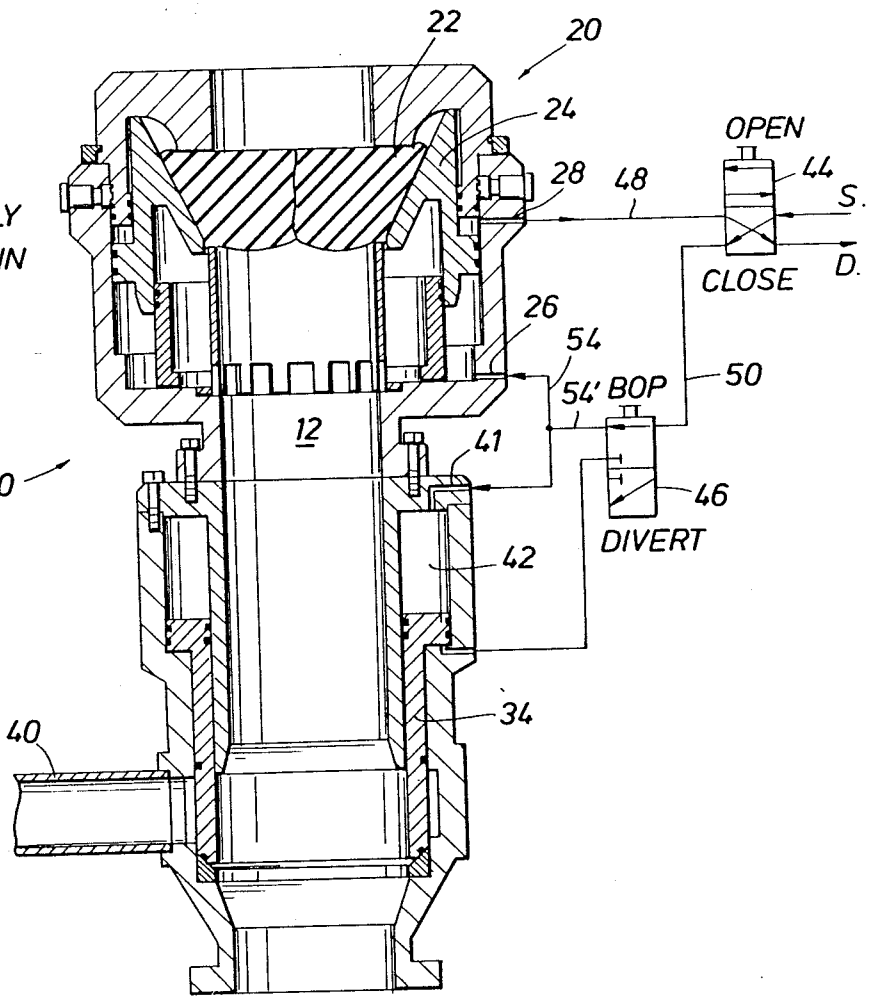
FIG. 2 shows the system, according to the invention, in which a hydraulic circuit controls the apparatus in a blowout preventer mode. The system is illustrated where the annular packing unit of an annular BOP completely closes off and seals the vertical flow path where no object such as a drill pipe, etc. is in the vertical flow path.

FIG. 2 illustrates the condition of the system after the hydraulic circuitry has been configured to put the system into a blowout preventer pressure containment mode. The second hydraulic valve 46 is shown remaining in the BOP position while the first hydraulic valve 44 has been moved to the "close" position.

In the closed position of the hydraulic valve 44, the source of pressurized hydraulic control fluid is directed via hydraulic line 50 and second hydraulic valve 46 to line 54' and line 54 to the closing port 26 of BOP 20. Providing a source of pressurized hydraulic fluid beneath the piston 24 causes it to move upwardly operably directing the annular packing unit 22 radially inwardly until it completely closes off the vertical flow path 12. By applying the source of pressurized hydraulic fluid to line 54' and line 54, the source of pressurized hydraulic fluid is also applied to the upper port 41 operably retaining the spool piston 34 in its lower position and operably preventing fluid communication between vent line 40 and the vertical flow path 12.

Figure 3:
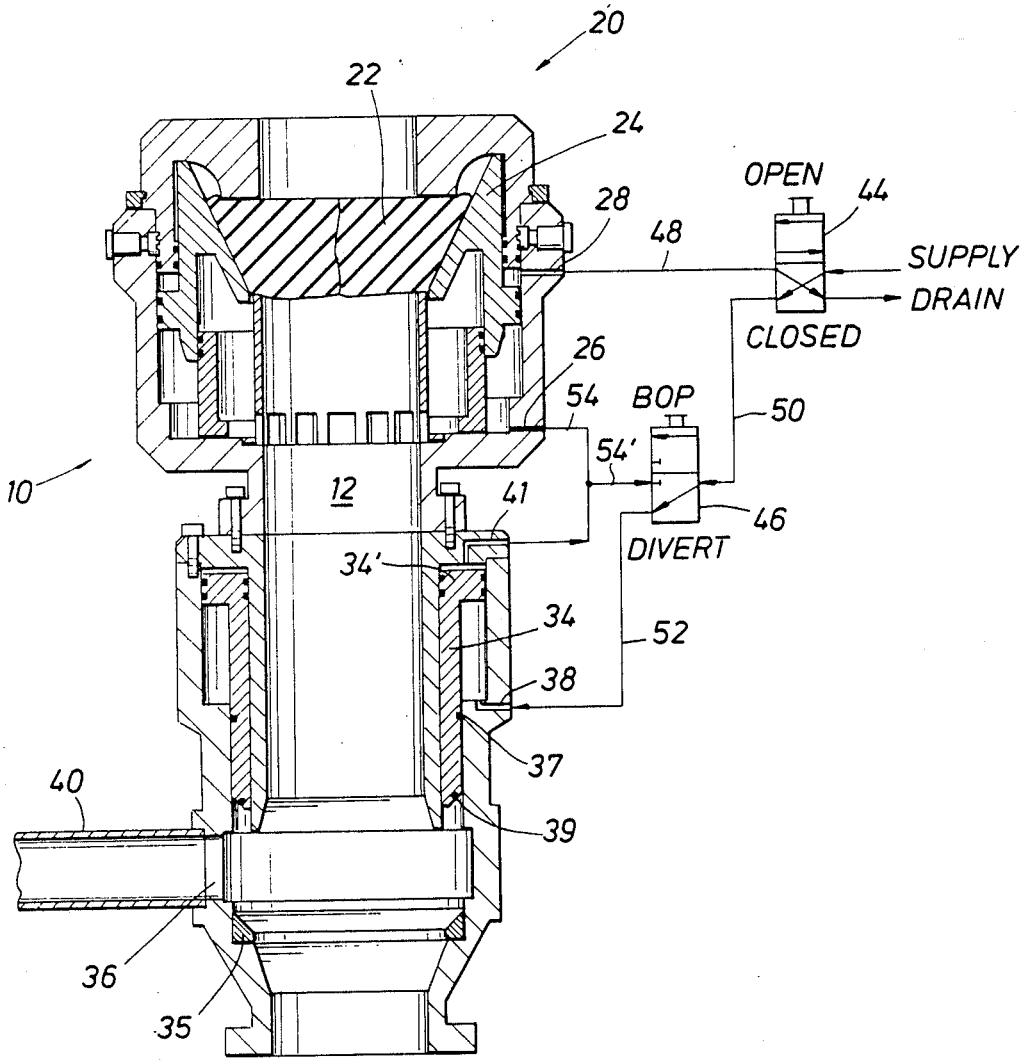
FIG. 3 shows the system, according to the invention, in which the hydraulic circuit controls the system to be connected as a diverter in which an opening to a vent line is provided and the vertical flow path is sequentially closed and sealed by the BOP unit.

FIG. 3 illustrates the system, according to the invention, after it has been put into the divert mode. FIG. 3 should be viewed as the end result of providing first hydraulic valve 44 to the closed position after the second hydraulic valve 46 has been moved to the divert position. In other words, FIG. 3 should be viewed as coming to the condition as illustrated from that illustrated in FIG. 1. In still other words, the second hydraulic valve 46 is first put to the divert position and then the first hydraulic valve 44 is moved to the closed position.

Before first hydraulic valve 44 is moved to the closed position, the vertical flow path 12 will be completely open. That is, the spool piston 34 will be in the lower position as illustrated in FIG. 1 and the annular piston 24 and the packing unit 22 will be in the relaxed or open position. When the first hydraulic valve 44 is moved to the closed position, the supply of pressurized hydraulic control fluid is applied via the first hydraulic valve 44, the hydraulic line 50 and the second hydraulic valve 46 to the hydraulic line 52 to the lower port 38. Application of a pressurized hydraulic control fluid beneath the upper part 34' of the spool piston 34 causes the piston to move upwardly to an upper position as illustrated in FIG. 3. An upward movement of spool annular piston 34 opens the outlet passage 36 allowing fluid communication from the vertical flow path 12 to vent line 40.

The upward movement of the spool piston 34 causes the hydraulic fluid in reservoir 42, as illustrated in FIG. 1, to move upwardly via the upper port 41 and line 54 to the closing port 26 of BOP 20. Displacement of the pressurized fluid from the reservoir 42 beneath the piston 24 causes it to move upwardly and thereby closing the annular packing unit 22 about an object in the vertical flow path 12 or completely closing the vertical flow path 12 even in the absence of any object in the well bore.

It should be observed that the annular piston 24 does not move appreciably upwardly until the spool piston 34 has moved upwardly sufficiently to open the outlet passage 36 to fluid communication with the vent line 40. Thus, the annular packing unit 22 sequentially closes after the outlet passage 36 has been uncovered. This sequential opening of the diverter spool outlet passage 36 and the closing of the annular BOP 20 insures that the system when in the divert mode can not be completely closed off in the event of a kick or other emergency.

The system 10 is returned to the open position by returning the first hydraulic valve 44 to the open position. As FIG. 1 illustrates, the supply of pressurized hydraulic control fluid is applied via line 48 to opening port 28 operably driving the annular piston 24 downwardly and forcing hydraulic fluid in the annular space 60 out the closing port 26 to the upper port 41 and driving the spool piston 34 downwardly to the lower position. Thus, as illustrated in FIG. 1, the system is returned to the open position of having the vertical flow path 12 open for normal drilling operations with the outlet passage 35 closed off by the lower part 34" of spool piston 34.

Figure 5:
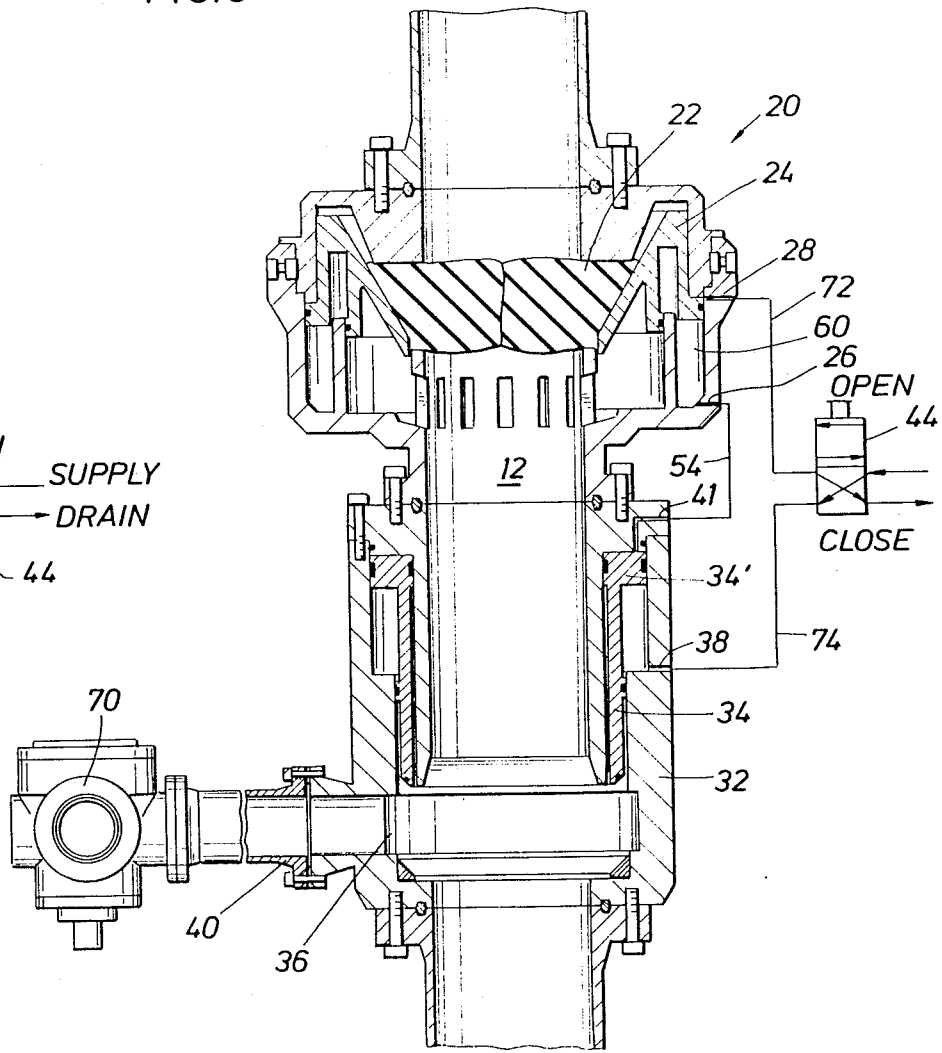
FIG. 5 shows the system, similar to FIG. 4, according to an second embodiment of the invention, in which a hydraulic valve controls the system setup as a diverter but where the diverter piston is in an open position to provide flow through the vent line and the vertical flow path is sequentially closed and sealed by the blowout preventer unit.
Figure 4:
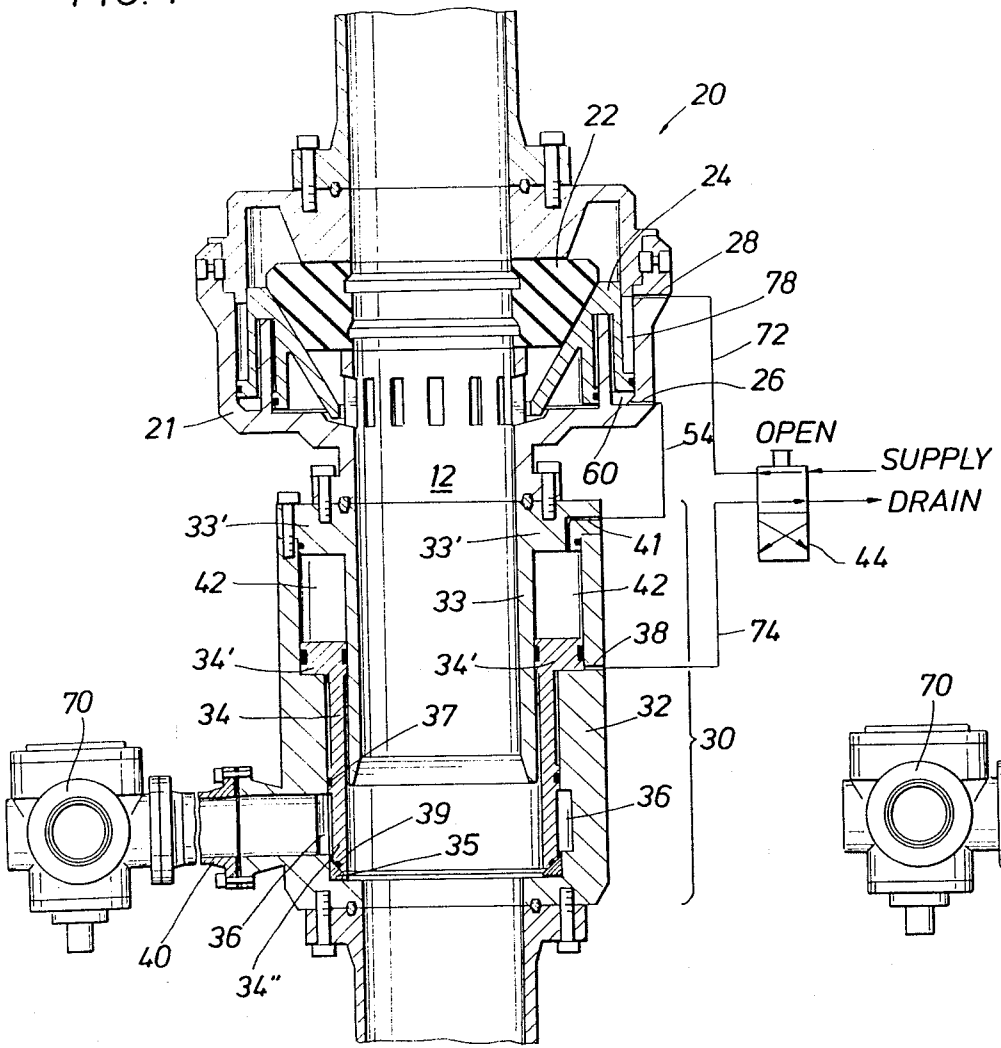
FIG. 4 shows an alternative embodiment of the system, according to the invention, in which a hydraulic valve controls the system set up in a diverter mode where a vent line is provided.

FIGS. 4 and 5 illustrate an alternative embodiment of the system adapted for use as a diverter. Although the system could find application in a floating drilling rig or even a land rig, its preferable application would be for bottom founded offshore drilling rigs.

According to the alternative embodiment of the invention, a blowout preventer 20 is connected in series above a diverter spool means 30. Although illustrated schematically as two separate units, the diverter spool housing 32 could be integral with the blowout preventer housing 21. Alternatively, the diverter spool housing 32 of the diverter spool means 30 could be separated vertically from the housing 21 of the blowout preventer 20 by providing an intermediate spool between the two housings. Such a configuration would be adapted to the spatial arrangement necessities of, for example, an offshore drilling platform or bottom founded offshore drilling rig. This spatial arrangement will be further discussed in detail below and is illustrated in FIGS. 9–17.

According to the alternative embodiment of the invention, the blowout preventer 20 is preferably an annular type blowout preventer having an annular resilient packing unit 22, an annular piston 24, an opening port 28 and a closing port 26. Such an annular blowout preventer (BOP) is well known in the art and functions to close and seal the packing unit about an object in the vertical flow path or bore 12 or to completely close and seal the vertical flow path 12 in the absence of an object therein. The blowout preventer functions to close about the vertical flow path 12 when a source of pressurized hydraulic control fluid is applied to the closing port 26 or, alternatively, to open when a source of pressurized hydraulic control fluid is applied to the opening port 28.

As illustrated in FIG. 4, the opening port 28 is connected to a source of pressurized hydraulic control fluid and the annular piston 24 is forced downwardly causing the resilient packing unit 22 to open in the usual fashion.

According to an alternative or second embodiment of the invention, the diverter spool means 30 has a spool housing 32 in which is disposed an annular diverter piston 34. A cylindrical member 33 is also disposed in the spool housing 32 defining an annular space between the spool housing 32 and the cylindrical member 33 in which the annular diverter piston 34 is disposed. As illustrated in FIG. 4, the annular diverter piston 34 is in a lower position. In such lower position, a sealed reservoir 42 of hydraulic fluid is provided between the upper part 34' and the uppermost portion 33' of the sleeve or cylindrical member 33.

An outlet passage 36 is provided in the lower part of the spool housing 32, and when the annular diverter piston 34 is in the lower piston, as illustrated in FIG . 4, the lower part 34" of the piston 34 covers and seals the outlet passage 36. A vent line 40 is connected to the spool housing 32 for communication with the outlet passage 36. In the lower position of the piston 34, the outlet passage 36 is closed from communication within the vertical flow path 12 of the system to the vent line 40. Seal 39 serves to seal fluid from the vertical flow path 12 to the outlet passage 36 and vent line 40 when the piston 34 is in the lower position. In the alternative embodiment of the invention, a "sacrificial" seal seat ring 35 is provided below the bottom with seal 39 in sealing the outlet passage 36 from the vertical flow path 12. The seal seat ring 35 may be easily replaced if it should erode during the divert mode of the system. A blast deflector/selector 70 is shown connected to the vent line 40.

According to the second embodiment of the invention, the lower control port 38 is provided for directing a source of pressurized hydraulic fluid beneath the upper part 34' of diverter piston 34 for the purpose of raising diverter piston 34 within the diverter housing 32. An upper control port 41 is provided for lowering the piston 34 within the housing 32 when a source of pressurized hydraulic fluid is applied to the upper port 41.

A hydraulic circuit is provided for connecting the system alternatively as a diverter or as a blowout preventer. The hydraulic circuit comprises a hydraulic valve 44, similar to the first hydraulic valve 44 shown in FIGS. 1–3, having an "open" position and a "close" position. A hydraulic line 72 is provided between the opening port 28 of the blowout preventer and the hydraulic valve 44. The hydraulic line 74 is provided between the hydraulic valve 44 and the lower port 38 of the housing 32 of the diverter spool means 30. A hydraulic line 54 is provided between the closing port 26 of blowout preventer 20 and the upper port 41 of the diverter spool 30. Where housing 21 of the blowout preventer and the housing 32 of the spool 30 are integral, line 54 may be provided within the combined integral housing.

In the "open" position illustrated of the hydraulic valve 44, a hydraulic circuit exists from a supply of pressurized hydraulic fluid through the hydraulic valve 44 to the opening port 28 of the blowout preventer 20 providing a source of pressurized hydraulic control fluid via the opening port 28 causing the annular piston 24 to remain in the lower position thereby maintaining the resilient packing unit 22 in the relaxed or open state. The fact that the annular piston 24 is in the lower position causes any hydraulic fluid in space 60 beneath the annular piston 24 to be displaced downwardly and simultaneous via the opening port 26, hydraulic line 54, and upper port 41 into reservoir 42 forcing piston 34 to its lower position. In the "open" position of the hydraulic valve 44, as illustrated in FIG. 4, the piston 34 remains in its lower position, operably closing off flow from the vertical flow path 12 to the vent line 40 and the annular blowout preventer 20 remains in an open position. Any hydraulic fluid below upper part 34' is displaced through lower port 38 via hydraulic line 74 to drain through the hydraulic valve 44.

FIG. 5 illustrates the second embodiment of the invention after the hydraulic valve 44 has been moved to the "close" position.

In the "close" position of the hydraulic valve 44, the source of pressurized hydraulic fluid is directed via hydraulic line 74 via lower control port 38. Application of a pressurized hydraulic control fluid beneath the upper part 34' of the piston 34 causes the piston 34 to move upwardly to an upper position as illustrated in FIG. 5. Any upward movement of the piston 34 opens the outlet passage 36 allowing fluid communication from the vertical flow path 12 to vent line 40.

The upward movement of the piston 34 causes the hydraulic control fluid in the reservoir 42, as illustrated in FIG. 4, to move upwardly via the upper port 41 and line 54 to the closing port 26 of the blowout preventer 20. Application of the pressurized control fluid from the reservoir 42 beneath the piston 24 causes the piston 24 to move upwardly thereby closing the annular packing unit 22 about an object in the vertical flow path 12 or, as illustrated in FIG. 5, completely closing the vertical flow path 12 even in the absence of any object in the flow path 12.

It should be observed that the annular piston 24 does not move upwardly until the piston 34 has moved upwardly sufficiently to open the outlet passage 36 to fluid communication with the vent line 40. Thus, the annular packing unit 22 sequentially closes after the outlet passage 36 has been adequately uncovered. This sequential opening of the diverter spool outlet passage 36 and the closing of the annular blowout preventer 20 insures that the system when in the divert mode can never be completely closed off in the event of a kick or other emergency. The hydraulic fluid used to open the piston 24, as shown in FIG. 4, drains via opening port 28 through hydraulic line 72 and through valve 44 so as to permit the upward movement of piston 24. The system as shown in FIG. 5 is returned to the open position by returning the hydraulic valve 44 to the open position.

As FIG. 4 illustrates, the supply of pressurized hydraulic control fluid is applied via line 74, as explained previously, to opening port 28 operable driving the annular piston 24 downwardly and forcing the hydraulic fluid in the BOP closing chamber 60 out the closing port 26 via hydraulic line 54 to the upper port 41 thereby driving the piston 34 downwardly to the lower position. Thus, as illustrated in FIG. 4, the system is returned to the open position of having the vertical flow path 12 completely open for normal drilling operations with the outlet passage 36 closed off by the lower part 34'' of the spool piston 34.

Figure 7:
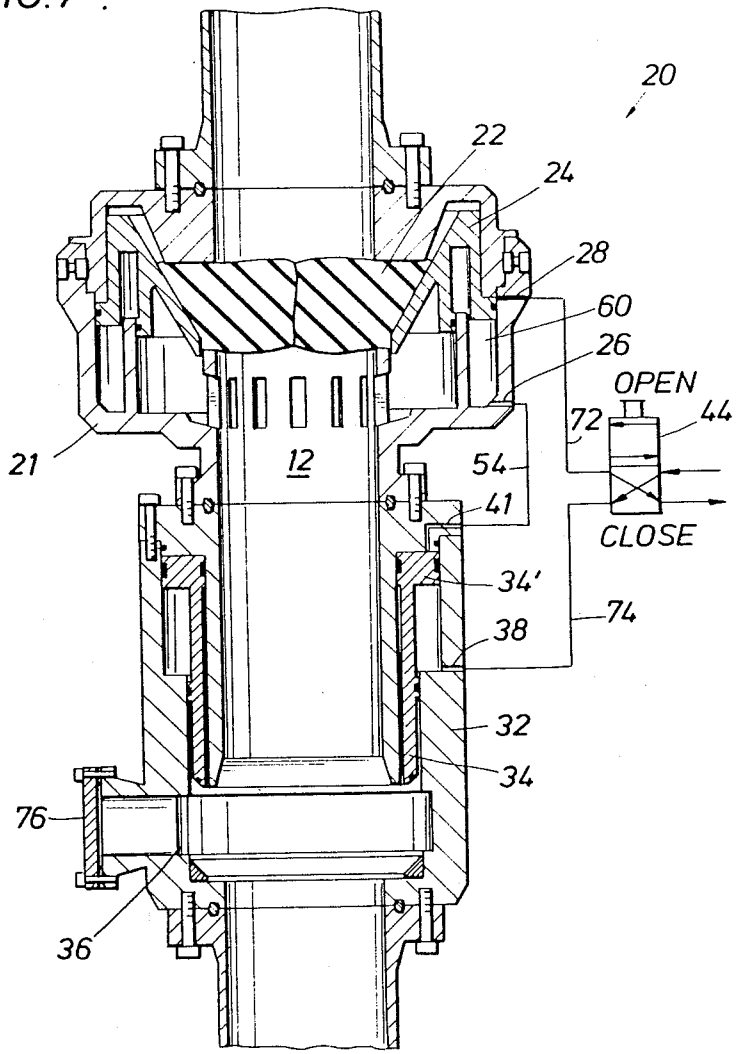
FIG. 7 shows the system, similar to FIG. 6, according to an second embodiment of the invention, in which a hydraulic valve controls the system where the diverter piston is shown in an open position and the vertical flow path is closed and sealed by the blowout preventer unit.
Figure 6:
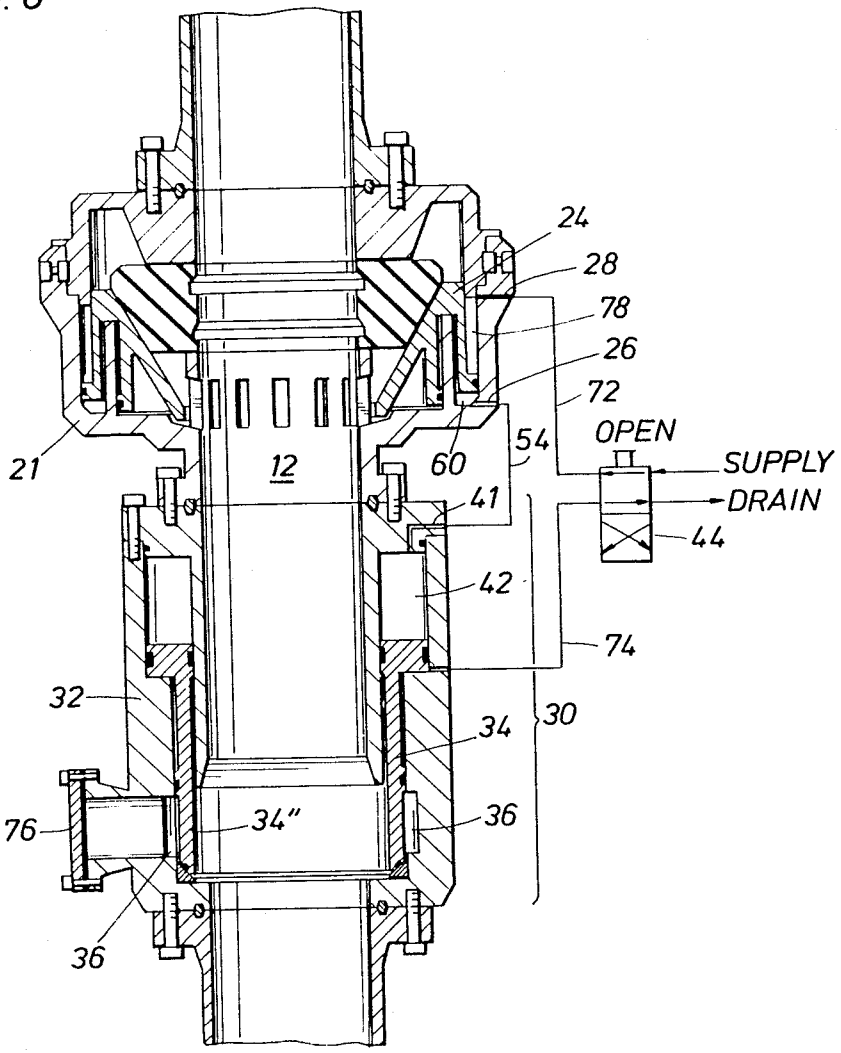
FIG. 6 shows the system, according to an second embodiment of the invention, in which a hydraulic valve controls the system to be connected in a blowout preventer pressure containment mode where the outlet passage is sealed by a blind flange or hub.

FIGS. 6 and 7 illustrate the second embodiment of the system and alternatively configured as a blowout preventer pressure containment system. FIG. 6 is similar to FIG. 4 in positioning of piston 24 and piston 34 so that the outlet passage 36 is closed by the lower part 34'' of piston 34 and the annular piston 24 is shown in an open position allowing flow through the vertical flow path 12. The hydraulic valve 44 is placed in "open" position similar to FIG. 4 so that the supply of hydraulic control fluid operates via hydraulic lines 72, 54 and 74 to position the pistons 24 and 34 in the positions shown. FIG. 6 further illustrates a closure means, preferably a blind flange or hub 76 secured to the diverter housing 32 having an outlet passage 36 provided in its wall. The blind flange or hub 76 is connected to the outlet passage 36 provided in the wall of the diverter housing 32 of the diverter spool means 30 so as to provide a blowout preventer pressure containment mode for the system.

FIG. 7 illustrates the condition of the alternative embodiment of the invention where the hydraulic valve 44 has been moved to the "close" position to put the system into a blowout preventer pressure containment mode.

In the "close" position of the hydraulic valve 44, the source of pressurized hydraulic control fluid is directed via line 74 to the lower port 38 of the diverter housing 32 beneath the upper part 34' of piston 34 causing the piston to move upwardly to an upper position as illustrated in FIG. 7. Upward movement of the annular piston 34 opens the outlet passage 36. The blind flange or hub 76, as illustrated in FIGS. 6 and 7, prevents fluid communication from the vertical flow path 12 so as to provide a seal containing pressure within the vertical flow path 12.

The upward movement of the piston 34 causes the reservoir 42 of hydraulic fluid, as shown in FIG. 6, to move upwardly via the upper port 41 and hydraulic line 54 to the closing port 26 of the blowout preventer 20. Application of the pressurized control fluid from the reservoir 42 beneath the piston 24 causes the piston 24 to move upwardly thereby closing the annular packing unit 22 about an object in the vertical flow path 12 or completely closing the vertical flow path 12 even in the absence of any object in the vertical flow path 12 as is illustrated in FIG. 7. The fluid in space 78, as shown in FIG. 6, is drained through opening port 28 in the blowout preventer housing 21 via hydraulic line 72 through the hydraulic valve 44 thereby permitting the movement of the annular piston 24 upwardly.

The system illustrated in FIG. 7 in a blowout preventer pressure containment mode is returned to the "open" position by moving the hydraulic valve 44 to the "open" position. As FIG. 6 illustrates, the supply of pressurized hydraulic control fluid is applied via line 72 to opening port 28 operably driving the annular piston 24 downwardly and forcing hydraulic fluid in the annular space 60 out the closing port 26 to the upper port 41 via hydraulic line 54 thereby driving the diverter piston 34 downwardly to the lower position. Thus, as illustrated in FIG. 6, the system is returned to the "open" position of having the vertical flow path 12 completely open for normal drilling operations with the outlet passage 36 closed off by the lower part 34'' of piston 34.

Figure 8:
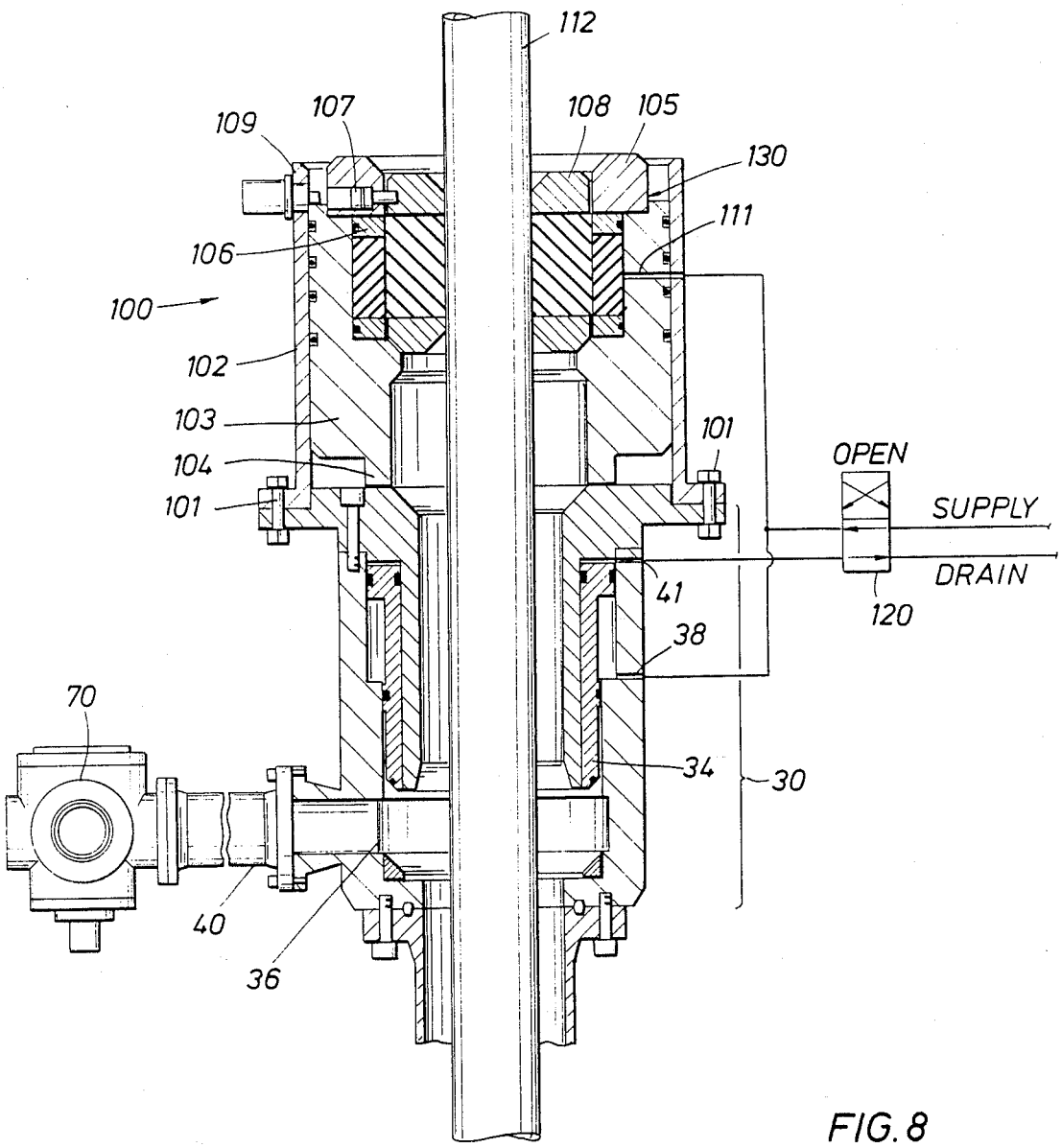
FIG. 8 shows the system, similar to FIGS. 6 and 7 in which an insert type annular sealing means is used in combination with the diverter spool according to the invention where the diverter piston is in the divert mode such that drilling fluid returns exit via a vent line and the vertical flow path of the system is closed by means of an insert type annular sealing apparatus.

FIG. 8 illustrates the use of diverter spool 30 according to the invention with an annulus sealing means of a type other than that shown in FIGS. 1–7. As illustrated, an insert type blowout preventer 100 is releasably fastened to spool 30 by bolts 101. An insert 103 is provided in housing 102, and has an annular mud guide 104. A blowout preventer insert 106 is secured by ring 105. Ring 105 has a spring latch mechanism 107 for latching a packer insert 108 inserted into the blowout preventer insert 106 and ring 105. The packer insert 108 extends to sealingly engage pipe 112 and complets the closing of the upper end 109 of the housing 102 to prevent escape of mud therebetween. Blowout preventer insert 106 is actuated by applying pressurized hydraulic fluid to port 111. An insert type blowout preventer 100 is illustrated in U.S. Pat. No. 3,791,442 to Watkins and is incorporated herein for all purposes.

Blowout preventer 100 when connected to diverter spool 30 as illustrated in FIG. 8 creates a diverter system comprising the preventer 100, the spool 30 and a hydraulic circuit for opening the diverter spool while closing the blowout preventer. The hydraulic circuit of FIG. 8 includes a valve 120 illustrated in the "close" position to open the diverter spool 30 and close the blowout preventer 100 via hydraulic lines extending from the close port 111 of blowout preventer and the lower port 38 of spool 30. A return line from upper port 41 also is connected to valve 120 such that when valve 120 is put in the "open" position, piston 34 of spool 30 is forced downwardly closing outlet 36 while blowout preventer 100 opens because of removal of supply pressure to closing port 111.

Figure 9:
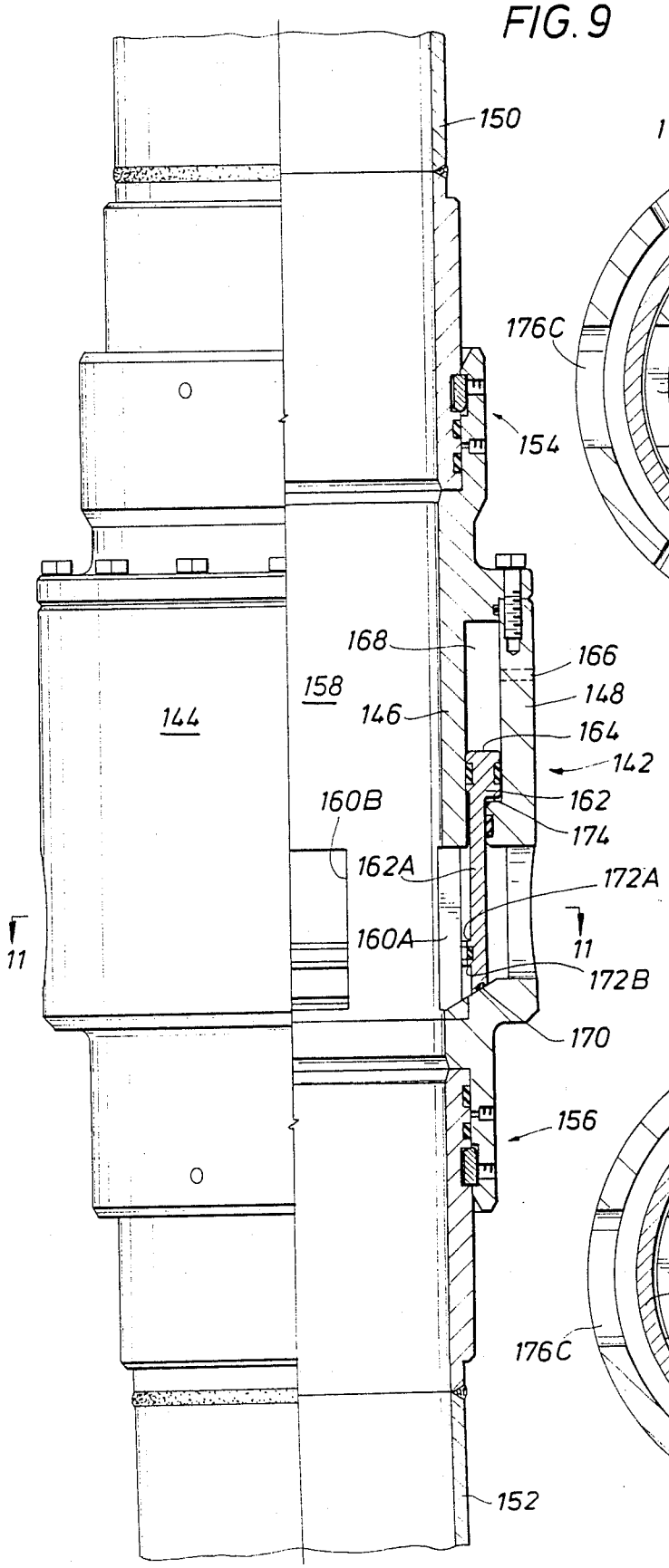
FIG. 9 illustrates an elevational view of the subsea diverter spool shown partially in section, in which the diverter piston is shown in the closed position.
Figure 11:
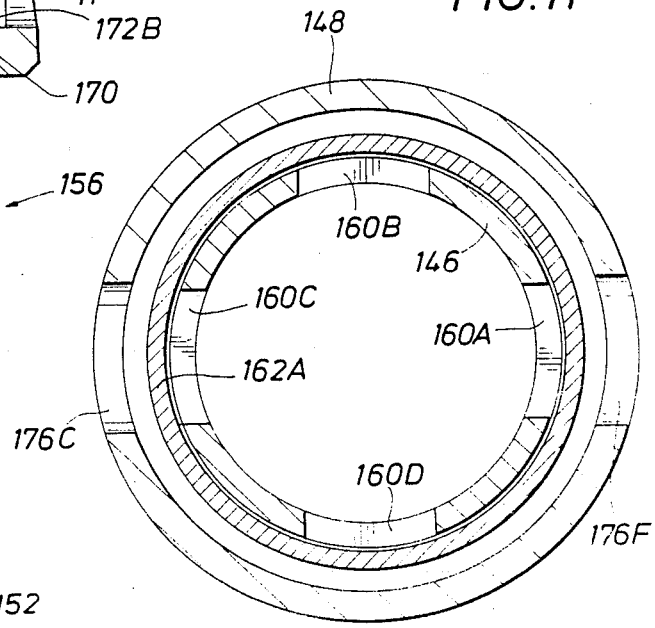
FIG. 11 illustrates a section view along lines 11—11 of FIG. 9.

FIG. 9 illustrates a subsea diverter spool, generally designated 142, which is provided with an automatic opening device or safety exhaust valve to a vent line. This subsea diverter spool 142 exhaust valve may be positioned subsea in the casing string, as best shown in FIGS. 12–17. The diverter spool 142 comprises a diverter housing 144 having an interior wall 146 and an exterior wall 148. The diverter housing 144 is adapted for connection in series with an upper casing string 150 and a lower casing string 152. An upper connection 154 and the lower connection 156 are conventional quick connections known to those skilled in the art. The diverter housing 144 has a bore 158 and outlet passages 160A, 160B, 160C and 160D, as best shown in FIG. 11, provided in interior wall 146.

Preferably, an annular diverter piston 162 having a sleeve 162A is slidably disposed between the interior wall 146 and the exterior wall 148 of the diverter housing 142. The piston 162 is movable relative to the diverter housing for closing the outlet passages 160A, 160B, 160C and 160D, as best shown in FIGS. 9 and 11. The interior or bore 158 of the diverter housing is opened to the sea when the diverter piston 162 is moved to the open position (not illustrated).

It is to be understood that the piston could alternatively be a gate valve or other non-annular shaped valve positioned between the interior wall 146 and the exterior wall 148 adjacent its respective outlet passage 160.

FIG. 9 additionally illustrates the piston 162 having a differential pressure sensor for automatic opening of the diverter spool 142. U.S. patent application Ser. No. 802,997 filed Nov. 29, 1985 for a Marine Riser Anti-Collapse Valve discloses fluid pressure actuated valves. U.S. patent application Ser. No. 802,997 is assigned to the same assignee as the present invention and is incorporated herein for all purposes. The co-inventor Joseph R. Roche of the U.S. patent application Ser. No. 802,997 is the sole inventor of the present invention.

The differential pressure sensor comprises a first area 164 of the piston 162 which is in communication with and pressure responsive to sea water pressure. Sea water pressure is provided through opening 166, shown in dashed lines, to chamber 168 formed by the exterior wall 148 and the interior wall 146. The annular piston 162 is sealingly slidable between the wall 146 and wall 148. The sea water pressure is determined by the head pressure which is in turn determined by the depth of the subsea diverter spool. The product of the sea water pressure and the first area 164 of the piston 162 tends to move the piston means 162 to the closed position, as shown in FIGS. 9 and 11.

A second area or shoulder 170 of the piston means 162 is in communication with and pressure responsive to the drilling fluid pressure from the bore 158 of the diverter housing 144. The product of the drilling fluid pressure and the second area or shoulder 170 tends to move the piston means 162 to the open position (not illustrated), but similar to the piston 34 location as shown in FIGS. 3, 5, 7 and 8.

The volume of the upper chamber 168 within the diverter housing 144 is variable in proportion to the horizontal position of the piston means 162 relative to the diverter housing 144. As shown in FIG. 9, the chamber 168 is provided with its full volume since the piston is located in the fully closed position.

The piston means 162 remains closed, as shown in FIG. 9, so long as the sum of the weight of the piston 162 and the product of the sea water pressure and the first area 164 is greater than the product of the drilling fluid pressure and the second area or shoulder 170. The piston automatically opens when the product of the drilling fluid pressure from within the bore 158 and the second area 170 is greater than the sum of the weight of the piston means and the product of the sea water pressure and the first area 164. The shoulders 172A and 172B provide equal pressure responsive areas on opposing sides and therefore their forces when acted upon by the drill fluid pressure would cancel.

Though not illustrated in FIG. 9, a hydraulic upper port and a hydraulic lower port connected to hydraulic lines, similar to upper port 41 and lower port 38 of FIG. 1, are preferably provided. These hydraulic lines could be used to adjust the pressure in the upper chamber 168 and lower chambers 174 to accommodate different head pressures entering through the opening 166. Additionally, the hydraulic lines may be used as a primary means for moving the piston between the open position and closed position as earlier disclosed. It should be understood that the different arrangements and sequencing for the hydraulic lines, as discussed previously and illustrated in FIGS. 1–8, may be used with the subsea diverter spool, as shown in FIGS. 9–17.

Figure 10:
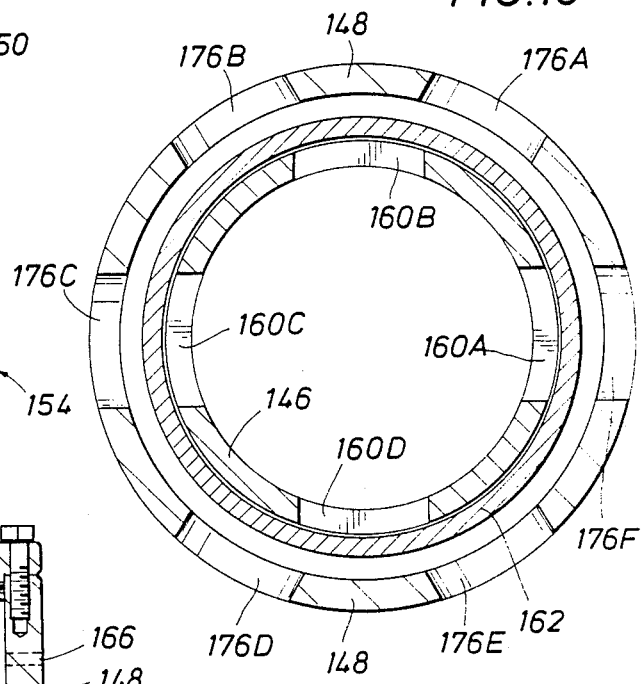
FIG. 10 illustrates an alternative embodiment of the subsea diverter spool having a plurality of ports.

As best shown in FIG. 10, a plurality of ports may alternatively be provided in the exterior wall 148 of the diverter housing 144 to diffuse and exhaust the drilling fluid to subsea when the piston 162 is moved to the open position.

FIG. 10 discloses six ports 176A, 176B, 176C, 176D, 176E and 176F equally spaced radially about the exterior wall 148 of the diverter housing 144. The axis of each 12" API studded port 176 in FIG. 10 is spaced 60° from its adjacent port though other spacing and sizing of the ports could be used. Though FIGS. 10 and 11 both show four outlet passages 160A, 160B, 160C and 160D provided in the interior wall 146, additional or fewer outlet passages could be provided to properly size the diffusion of the fluid.

The preferred embodiment of diverter spool 142, as shown in FIG. 9, is provided with a thirty inch bore at a rating pressure of one hundred pounds per square inch. Additionally, the preferred diverter spool has an operating fluid pressure of fifteen hundred pounds per square inch nominal.

The sizing and positioning of ports 176 and outlet passages 160 provide a desired subsea exhaust and diffuse function. Exhausting and diffusing the flowing well fluid safely into the sea protects rig personnel from undesirable effects of thrust impact, erosion and fire. Additionally, the diffusion of the drilling fluids including gases into the sea has been shown to reduce, if not obviate, the problem of combustion of gases in close proximity to the drilling rig.

The diverter spool 142 as shown structurally in detail in FIG. 9, allows the spool to be driven with the casing string and therefore facilitates its recovery. This drivability and recoverability of the diverter spool provides economic benefits to the user in installation of the spool 142.

Turning now to FIGS. 12–17, the position of the subsea diverter spool 142 is illustrated relative to a blowout preventer located above sea. FIG. 12 illustrates a bottom supported drilling rig, generally designated 178, having a plurality of longitudinal structural members 180A, 180B, 180C and 180D, as best illustrated in FIGS. 12, 15 and 16. The structural members 180 extend upwardly from the sea floor 182. A first subsea vent line 184 is connected to and in fluid communication with a diverter housing outlet passage 176, similar to vent line 40 as shown in FIG. 1. A second vent line 186, located 180 degrees radially from the first vent line 184, is connected in similar fashion to vent line 184 as best shown in FIG. 12.

FIGS. 13 and 14 illustrate the similar placement of the first vent line 188 and the second vent line 190. FIGS. 13 and 14 further disclose along with FIG. 14A the quick connection means of the vent lines to the structural members 180. This quick connection means comprises a T-shaped member 192 fixed to the exterior surface of the structural member 180C which is received to a corresponding exterior locking member 194. Other quick connection means as known in the prior art may be used.

FIGS. 12, 15 and 16 disclose an alternative connection means using high tension wires 196 and 198 which are connected to the longitudinal support members 180A and 180B and 180C and 180D, respectively to the drilling floor 200. A detail of a quick connection of wire 198 to member 180D is shown in FIG. 16A. The connection comprises the wire 198 connected to an eye hook 202 which is pivotably connected to a locking means 204. Locking means 204 is removably connect to T-shaped member 206 fixedly fastened to the structural member 180D. Other quick connection means as known in the prior art may be used.

The fluid return system as shown in FIGS. 12, 13 and 15 includes a bottom supported drilling rig 178 with a drilling rig floor 200 supported above sea level by the structural members 180. Blowout preventer 208, as shown in dashed lines in FIGS. 12, 13 and 15, is disposed above the sea level but below the drilling rig floor 200. The upper casing string 150 and the lower casing string 152 provide the desired placement of the subsea diverter spool 142 and are similar to casing string shown in FIG. 9. The upper casing string 150 disposed between the subsea diverter spool 142 and the blowout preventer 208 provides a long column or long fluid cushion. This long column reduces forces acting on and erosion to the blowout preventer by remotely positioning the preventer from the kick. Both the forces and fluid action on the occasion of a kick are reduced on the blowout preventer 208 in this spatial arrangement of the diverter spool 142 relative to the blowout preventer 208.

Hydraulic circuit line 210, shown in FIG. 13, similar to the hydraulic circuit line 154 as shown in FIGS. 1–4, is used for the sequencing of the opening and closing of the blowout preventer and diverter spool as previously discussed.

It is to be understood that the different arrangements of hydraulic circuit lines and valving as discussed previously may be used with the blowout preventer 208 and the diverter spool 142 now separated by an upper casing 150, as shown in FIGS. 12–17.

FIG. 17 illustrates a floating rig platform or vessel 212 having a subsea diverter spool connected directly to a well-head 214. The wellhead 218 is provided on the sea floor 182. The upper casing string 150, between the blowout preventer 208 and diverter spool 142, also provides the beneficial and desirable positioning to prevent erosion of the elastomeric materials in the blowout preventer 208. As can be seen by FIGS. 12–17, the deployment of the vent lines is quicker and less costly while providing a better support than the prior art methods for connection of vent lines. Additionally, it is seen from the present invention that the elimination of valves and other fluid control means provides savings in initial costs and in operation and maintenance of the fluid return system.

Various modifications and alterations in the described structures will be apparent to those skilled in the art of the foregoing description which does not depart from the spirit of the invention. For this reason, these changes are desired to be included in the appended claims. The claims which follow recite the only limitation to the present invention and the descriptive manner which is employed for setting forth the embodiments and is to be interpreted as illustrative and not limitative.

What is claimed is:

1. A system adapted for alternative use as a blowout preventer or a diverter, comprising a blowout preventer having a resilient packing means and having a closing port and an opening port by which connection of a source of pressurized hydraulic control fluid to the closing port closes the blowout preventer and connection of a source of pressurized hydraulic fluid to the opening port opens the blowout preventer, the blowout preventer when open having a vertical flow path for drilling fluid returns, a diverter spool means having a vertical flow path and disposed in series with and below the blowout preventer, hydraulic lines connected respectively between the opening port of the blowout preventer and said single hydraulic valve, between said single hydraulic valve and the lower port of the housing of the diverter spool means, and between the upper port of the housing of the diverter spool means and the closing port of the blowout preventer, and a reservoir of hydraulic control fluid disposed in the diverter housing above the diverter piston when the piston is in the lower position, whereby when the hydraulic valve is in the open position, a source of pressurized hydraulic control fluid is applied to the opening port of the blowout preventer thereby opening the blowout preventer and maintaining the diverter piston in its lower position, and when the hydraulic valve is in the close position, a source of pressurized hydraulic fluid is applied to the lower port of the diverter spool means operably raising the diverter piston from a lower position to an upper position, opening said outlet passage in said housing, forcing the hydraulic fluid from said reservoir above the diverter piston to the closing port of the blowout preventer via the hydraulic line between the upper port of the housing of the spool means and the closing port of the blowout preventer and operably sequentially closing the blowout preventer after the outlet passage in the diverter housing is opened.

2. The system of claim 1 further comprising a vent the spool means having a diverter housing having an outlet passage provided in its wall, a diverter piston having an annular wall and disposed within the housing, a lower control port in said housing by which connection of a source of pressurized hydraulic fluid to the lower port raises said piston from a lower position to an upper position and an upper control port by which connection of a source of pressurized hydraulic fluid to the upper port lowers said piston from an upper position to a lower position in said housing, said outlet passage in said housing wall being closed off by the annular wall of the piston when said piston is in said lower position and being open to the interior of the housing when in said upper position, and hydraulic circuit means for providing pressurized hydraulic control fluid to said lower port in said diverter housing thereby raising said diverter piston from its lower position and opening said outlet passage and for providing control fluid to said closing port of said blowout preventer thereby closing said blowout preventer, wherein said hydraulic circuit means includes, a single hydraulic valve having an open position and a close position, line connected to said outlet passage provided in the housing wall of the diverter spool means thereby providing a divert mode for the system when said diverter piston raises from its lower position and opens said outlet passage while sequentially closing said blowout preventer, and further comprising a blast deflector/selector connected to said vent line.

3. The system of claim 1 further comprising a closing means connected to said outlet passage provided in the housing wall of the diverter spool means for closing said outlet passage when said diverter piston raises from its lower position operably providing a blowout preventer mode for the system.

4. The system of claim 3 wherein said closing means is a blind flange.

5. The system of claim 3 wherein said closing means is a hub.

6. A system adapted for alternative use as a blowout preventer or a diverter, comprising a blowout preventer having a resilient packing means and having a closing port and an opening port by which connection of a source of pressurized hydraulic control fluid to the closing port closes the blowout preventer and connection of a source of pressurized hydraulic fluid to the opening port opens the blowout preventer, the blowout preventer when open having a vertical flow path for drilling fluid returns, a diverter spool means having a vertical flow path and disposed in series with and below the blowout preventer, the spool means having a diverter housing having an outlet passage provided in its wall, a diverter piston having an annular wall and disposed within the housing, a lower control port in said housing by which connection of a source of pressurized hydraulic fluid to the lower port raises said piston from a lower position to an upper position and an upper control port by which connection of a source of pressurized hydraulic fluid to the upper port lowers said piston from an upper position to a lower position in said housing, said outlet passage in said housing wall being closed off by the annular wall of the piston when said piston is in said lower position and being open to the interior of the housing when in said upper position, means for alternatively connecting a vent line or a closure means to said outlet passage in the wall of the diverter housing, hydraulic conduit means for connecting the upper control port of said diverter piston with the closing port of the blowout preventer, a reservoir of hydraulic control fluid disposed in the diverter housing above the diverter piston when the piston is in the lower position, and hydraulic circuit means for connecting a source of pressurized hydraulic control fluid to said lower control port of said diverter housing, operably raising said diverter piston from its lower position and opening said outlet passage in the wall of the diverter housing while forcing hydraulic control fluid from said reservoir to said closing port of the blowout preventer via said hydraulic conduit means and operably closing said blowout preventer.

7. The system of claim 6 further comprising a vent line connected to said outlet passage whereby when a source of pressurized hydraulic control fluid is applied to said lower control port of said diverter housing, fluid in said drilling spool is diverted via said vent line while the vertical flow path is closed by the blowout preventer.

8. The system of claim 6 further comprising a closure means connected to said outlet passage whereby when a source of pressurized hydraulic control fluid is applied to said lower control port of said diverter housing, fluid in said diverter and blowout preventer is contained therein by the closure means and the closing of the vertical flow path by the blowout preventer.

9. The system of claim 6 wherein said closure means is a blind flange.

10. A diverter spool adapted for use with a drilling rig annulus sealing means, the annulus sealing means having a closing port by which application of pressurized hydraulic fluid to the closing port closes the annulus sealing means, the diverter spool comprising, a diverter housing having an outlet passage provided in its wall, means for connecting the diverter housing below the annulus sealing means, a diverter piston having an annular wall and disposed within the housing, a lower control port in said housing by which connection of a source of pressurized hydraulic fluid to the lower port raises said piston from a lower position to an upper position and an upper control port by which connection of a source of pressurized hydraulic fluid to the upper port lowers said piston from an upper position to a lower position in said housing, and said outlet passage in said housing wall being closed off by the annular wall of the piston when said piston is in said lower position and being open to the interior of the housing when said piston is raised from said lower position.

11. The diverter spool of claim 10 further comprising, hydraulic conduit means for connecting with said lower control port of said diverter housing and connectable with said closing port of said annulus sealing means.

12. The diverter spool of claim 11 further comprising, means for applying a source of pressurized control fluid to the diverter housing lower control port and to said closing port of said annulus sealing means whereby, connecting said hydraulic conduit means between said lower control port and to said closing port of said annulus sealing means causes the diverter piston to move upwardly operably opening said outlet passage in said housing wall, and causes the annulus sealing means to close the annulus of the annulus sealing means.

* * * * *